US005399174A

United States Patent [19]

Yeo et al.

[11] Patent Number: 5,399,174

[45] Date of Patent: Mar. 21, 1995

[54] PATTERNED EMBOSSED NONWOVEN FABRIC, CLOTH-LIKE LIQUID BARRIER MATERIAL

[75] Inventors: Richard S. Yeo, Dunwoody, Ga.; Duane G. Uitenbroek, Little Chute, Wis.; Jennifer R. Powers, Woodstock, Ga.

[73] Assignee: Kimberly-Clark Corporation, Neenah, Wis.

[21] Appl. No.: 43,335

[22] Filed: Apr. 6, 1993

[51] Int. Cl.[6] ..... A61F 13/15; A61F 13/20

[52] U.S. Cl. ..... 604/365; 604/366; 604/370; 604/378; 604/384

[58] Field of Search ..... 604/358, 365, 366, 368, 604/370, 372, 374, 375, 378, 379, 380, 383, 384, 385.1; 428/198, 288, 296, 362, 373

[56] References Cited

U.S. PATENT DOCUMENTS

| | | | |
|---|---|---|---|
| 3,765,997 | 10/1973 | Dunning . | |
| 4,035,219 | 7/1977 | Cumbers . | |
| 4,041,203 | 8/1977 | Brock et al. . | |
| 4,042,740 | 8/1977 | Krueger . | |
| 4,068,036 | 1/1978 | Stanistreet . | |
| 4,103,058 | 7/1978 | Humlicek . | |
| 4,306,929 | 12/1981 | Menikheim et al. . | |
| 4,488,928 | 12/1984 | Ali Khan et al. . | |
| 4,493,868 | 1/1985 | Meitner . | |
| 4,500,384 | 2/1985 | Tomioka et al. . | |
| 4,548,856 | 10/1985 | Ali Khan et al. . | |
| 4,555,811 | 12/1985 | Shimalla . | |
| 4,592,943 | 6/1986 | Cancian et al. . | |
| 4,595,629 | 6/1986 | Mays . | |
| 4,681,801 | 7/1987 | Eian et al. . | |
| 4,684,570 | 8/1987 | Malaney . | |
| 4,725,473 | 2/1988 | Van Gompel et al. | 604/380 |
| 4,741,941 | 5/1988 | Englebert et al. . | |
| 4,753,840 | 6/1988 | Van Gompel | 604/379 |
| 4,756,786 | 7/1988 | Malaney . | |
| 4,774,124 | 9/1988 | Shimalla et al. . | |
| 4,787,947 | 11/1988 | Mays . | |
| 4,812,284 | 3/1989 | Fleissner . | |
| 4,874,666 | 10/1989 | Kubo et al. | 428/398 |
| 4,883,707 | 11/1989 | Newkirk . | |
| 5,115,544 | 5/1992 | Widen . | |
| 5,137,600 | 8/1992 | Barnes et al. . | |
| 5,143,774 | 9/1992 | Cancio et al. . | |
| 5,143,779 | 9/1992 | Newkirk et al. . | |
| 5,231,122 | 7/1993 | Palumbo et al. | 604/370 |

FOREIGN PATENT DOCUMENTS

| | | |
|---|---|---|
| 0342646 | 11/1989 | European Pat. Off. . |
| 0492554 | 7/1992 | European Pat. Off. . |
| 0586924 | 3/1994 | European Pat. Off. . |
| 0586937 | 3/1994 | European Pat. Off. . |
| 1073181 | 6/1967 | United Kingdom . |
| 33457 | 2/1975 | United Kingdom . |
| 2127864 | 4/1984 | United Kingdom . |

OTHER PUBLICATIONS

Database WPI. Section Ch, Week 8541, Derwent Publications Ltd., London, GB; Class A35, AN 85-253280 & JP,A,60 167 958 (Asahi Chemical Ind. KK) 31 Aug. 1985 (Abstract).

*Primary Examiner*—Randall L. Green
*Assistant Examiner*—P. Zuttarelli
*Attorney, Agent, or Firm*—William D. Herrick

[57] ABSTRACT

A patterned nonwoven fabric comprising polymeric strands which include a primary polymeric component and are bonded together without the use of compression, but instead with a heat activated adhesive polymeric component which adheres the respective primary components together. The fabric has an embossed pattern of densified areas separated by high loft areas. Preferably, the strands are continuous, crimped, multicomponent filaments. Also preferably, the nonwoven fabric is laminated to a liquid barrier film to form an outercover material for products such as personal care absorbent articles, and the like. Methods for making these materials are also encompassed.

14 Claims, 3 Drawing Sheets

PATTERNED EMBOSSED NONWOVEN FABRIC, CLOTH-LIKE LIQUID BARRIER MATERIAL

TECHNICAL FIELD

This invention relates to patterned embossed nonwoven fabrics and more particularly relates to liquid barrier materials such as the outer cover of personal care absorbent articles which include a layer of patterned embossed nonwoven fabric.

BACKGROUND OF THE INVENTION

Nonwoven fabrics are useful for a wide variety of applications, including absorbent personal care products, garments, medical applications, and cleaning applications. Nonwoven personal care products include infant care items such as diapers, child care items such as training pants, feminine care items such as sanitary napkins, and adult care items such as incontinence products. Nonwoven garments include protective workwear and medical apparel such as surgical gowns. Other nonwoven medical applications include nonwoven wound dressings and surgical dressings. Cleaning applications for nonwovens include towels and wipes. Still other uses of nonwoven fabrics are well known. The foregoing list is not considered exhaustive.

Various properties of nonwoven fabrics determine the suitability of nonwoven fabrics for different applications. Nonwoven fabrics can be engineered to have different combinations of properties to suit different needs. Variable properties of nonwoven fabrics include liquid handling properties such as wettability, distribution, and absorbency, strength properties such as tensile strength and tear strength, softness properties, durability properties such as abrasion resistance, and aesthetic properties.

The manufacture of nonwoven fabrics is a highly developed art. Generally, nonwoven webs and their manufacture involve forming filaments or fibers and depositing the filaments or fibers in such a manner so as to cause the filaments or fibers to overlap or entangle. Depending on the degree of web integrity desired, the filaments or fibers of the web may then be bonded by means such as an adhesive, the application of heat or pressure, or both, sonic bonding techniques, or hydroentangling, or the like. There are several methods within this general description; however, one commonly used process is known as spunbonding and resulting nonwoven fabric is known as spunbond fabric.

Generally described, the process for making spunbond nonwoven fabric includes extruding thermoplastic material through a spinneret and drawing the extruded material into filaments with a stream of high velocity air to form a random web on a collecting surface. Such a method is referred to as meltspinning. Spunbond processes are generally defined in numerous patents including, for example, U.S. Pat. No. 4,692,618 to Dorschner, et al.; U.S. Pat. No. 4,340,563 Appel, et al.; U.S. Pat. No. 3,338,992 to Kinney; U.S. Pat. No. 3,341,394 to Kinney; U.S. Pat. No. 3,502,538 to Levy; U.S. Pat. No. 3,502,763 to Hartmann; U.S. Pat. No. 3,909,009 to Hartmann; U.S. Pat. No. 3,542,615 to Dobo et al.; and Canadian Patent 803,714 to Harmon.

Other methods of making nonwoven fabrics involve the formation of fibrous webs with staple fibers. As used herein, polymeric fibers and filaments are referred to generically as polymeric strands. Filaments means continuous strands of material and fibers means cut or discontinuous strands having a definite length. Staple fibers may be formed into entangled webs by conventional processes such as carding, airlaying, or the like.

Although nonwoven fabric properties such as liquid handling properties, strength properties, softness properties and durability properties, are normally of primary importance in designing nonwoven fabrics, the appearance and feel of nonwoven fabrics are often critical to the success of a nonwoven fabric product. The appearance and feel of nonwoven fabrics is particularly important for nonwoven fabrics which form exposed portions of products. For example, it is often desirable that the outer covers of nonwoven fabric products have a cloth-like feel and a pleasing decorative design.

Outer covers of personal care products typically function as a liquid barrier and normally include a solid film of thermoplastic material such as polyethylene film rather than a nonwoven fabric. As a result, such materials often have a firm, smooth outer surface whereas it is more desirable that such materials have a more cloth-like feel.

One method of applying a decorative design to nonwoven products is by printing a decorative design on the outer cover with ink. However, printing does not alter the feel of the material. Embossing is one method to alter the feel of nonwoven fabrics and add a decorative design. Different methods for embossing nonwoven fabrics and films are known. Some bonding methods are designed primarily to affect the strength properties of the fabric and are not capable of imparting a particularly decorative design to the fabric. One such example is a method disclosed in U.S. Pat. No. 4,592,943 to Cancian et al. In that method, a nonwoven web is heated as the web passes between two grids so that the grids impart a pattern of rectangular densified areas to the web. Although this method is effective to alter the strength properties of the fabric, its use in applying a decorative pattern to fabric is limited because the possible designs of the grids are limited. A more versatile method of embossing nonwoven fabrics and films is pattern roll embossing. For example, U.S. Pat. No. 4,774,124 to Shimalla et al. discloses a method wherein a pair of pattern embossing rollers are used to emboss nonwoven fabric.

Despite the advances in the art described above, there is still a need for improved patterned nonwoven webs and methods of their manufacture. In particular, there is a need for liquid barrier outer cover materials with improved appearance and feel and improved methods for making such materials.

SUMMARY OF THE INVENTION

Accordingly, an object of the present invention is to provide an improved patterned nonwoven fabric.

Another object of the present invention is to provide a more efficient and economical method for making patterned nonwoven fabric.

Another object of the present invention is to provide nonwoven fabric embossed with relatively detailed patterns and methods for making the same.

Still another object of the present invention is to provide improved liquid barrier outer cover materials for nonwoven fabrics.

A further object of the present invention is to provide an efficient and economical process for making patterned liquid barrier outer cover materials.

A still further object of the present invention is to provide liquid barrier outer cover materials with relatively detailed embossed patterns and methods for making the same.

Yet another object of the present invention is to provide liquid barrier outer cover materials with a cloth-like feel and improved aesthetic properties.

Therefore, there is provided a patterned nonwoven fabric comprising polymeric strands which include a primary polymeric component and are bonded together with a heat-activated adhesive polymeric component which adheres the respective primary components together without compression. The fabric has an embossed pattern of densified areas separated by high loft areas. Preferably, the nonwoven fabric is laminated to a liquid barrier film to form an outer cover material for products such as personal care absorbent articles and the like. According to one aspect of the present invention, the nonwoven fabric includes continuous polymeric filaments. According to another aspect of the present invention, the nonwoven fabric includes crimped polymeric strands. Methods for making these materials are also encompassed by the present invention.

The nonwoven fabric of the present invention has a cloth-like feel even when laminated to a barrier film. In addition, because the fabric has relatively high loft, when embossed, it has a relatively distinct pattern because of the depth of the pattern which is formed between the high loft areas. Furthermore, because the nonwoven fabric is bonded with adhesive and without compression before embossing, the high loft areas are more durable and less likely to fray than if the material was simply embossed. When the nonwoven fabric is made with crimped fibers or filaments, the loft of the unembossed areas is even higher and the pattern is even more distinct.

According to one embodiment, the nonwoven fabric of the present invention comprises continuous polymeric filaments extending continuously along the length of the fabric. Each filament has a primary polymeric component extending continuously along the length of the filament. The filaments are bonded together without the use of compression, but instead are bonded with a heat-activated adhesive polymeric component which adheres the respective primary components together. The fabric is then embossed with a pattern of densified areas separated by high loft areas.

The present invention also encompasses a process for making a nonwoven fabric such as the above disclosed nonwoven fabric with continuous polymeric filaments. This process includes the steps of: melt-spinning continuous spunbond polymeric filaments; drawing the continuous filaments; quenching the filaments; thereafter, collecting the drawn filaments on a moving forming surface to form a nonwoven fabric web of continuous filaments; bonding together the filaments of the web with a heat activated polymeric adhesive to integrate the web without the application of pressure; and embossing the web with a pattern of densified areas separated by high loft areas. This continuous process provides for production of the nonwoven fabric of the present invention in a single process line.

According to another embodiment, the nonwoven fabric of the present invention comprises polymeric strands (fibers or filaments, or both) which are crimped. Preferably, the strands have natural helical crimp which adds bulk to the fabric. Preferably, the strands have from about 5 to about 15 crimps per extended inch of strand, counting 1 crimp per cycle of the helical strands according to method described in ASTM-3937.

The present invention also encompasses a process for making the above-described nonwoven fabric comprising crimped polymeric strands. This process includes the steps of: forming a web of crimped polymeric strands having a primary polymeric component; bonding together the filaments of the web with a heat activated polymeric adhesive to integrate the web without the application of pressure; and embossing the web with a pattern of densified areas separated by high loft areas.

The nonwoven fabric of the present invention is bonded by heating the web. The fabric may be heated by forcing heated air through the web. There are several suitable methods for applying the heat-activated adhesive polymer to the web. According to one method, the heat-activated adhesive polymer is added as a polymeric powder and the web is heated to activate the adhesive powder and bond the fibers or filaments together. Another suitable method for adding the heat-activated adhesive polymer to the fabric is to add strands of the heat-activated adhesive polymer to the web and then heat the web to activate the adhesive strands. Still another method of adding the heat-activated adhesive polymer to the fabric is to include multicomponent strands in the fabric. The multicomponent strands include the primary polymeric component and the heat-activated adhesive component. The primary and adhesive components are arranged in substantially distinct zones across the cross-section of the multicomponent strands and extend continuously along the length of the multicomponent strands. The adhesive component constitutes at least a portion of the peripheral surface of the multicomponent strands continuously along the length of the strands. The multicomponent strands are bonded by heating the web to a temperature which is sufficient to activate the adhesive component of the strands and is less than the melting temperature of the primary polymeric component of the strands. As a result, the multicomponent strands become fused at their points of contact.

Another advantage to using multicomponent strands is that multicomponent strands can be made with a high level of natural helical crimp when the respective components are properly arranged. It is particularly advantageous when making the fabric of the present invention with continuous multicomponent filaments in a continuous spunbond process to activate the latent helical crimp of the filaments before the filaments are collected on the forming surface. This results in a lofty fabric web and is a relatively low cost process.

Preferably, the fabric of the present invention is embossed by passing the fabric web through the nip between a pair of embossing rolls, at least one of the rolls being heated. The total embossed area of the fabric is preferably from about 5 to about 30% of the surface area of the fabric.

According to yet another aspect of the present invention, a composite material is provided comprising a layer of nonwoven fabric laminated to a polymeric film. The layer of nonwoven fabric comprises polymeric strands which include a primary polymeric component. The strands are bonded together, as described above, with a heat-activated adhesive polymeric component which adheres the respective primary components of the strands together without compression. The fabric has an embossed pattern of densified areas separated by high-loft regions, also as described above. Preferably, the polymeric film is a liquid barrier film when the composite material of the present invention is used to make the outer cover of products such as personal care absorbent products. The layer of fabric in the polymeric film can be laminated with an adhesive or can be laminated during the embossing step by simultaneously passing the polymeric film and the nonwoven fabric together through the nip between a pair of embossing rolls with at least one of the rolls being heated.

The nonwoven fabric of the present invention can be used to make a variety of products including personal care articles such as infant diapers, adult incontinence products, feminine care absorbent products, and training pants. The nonwoven fabric of the present invention is also useful to make garments, medical products and cleaning products. The composite material of the present invention is particularly useful as an outer cover liquid barrier material for personal care articles such as infant diapers. The composite material of the present invention provides an outer cover material with a cloth-like feel and an aesthetic design.

Still further objects and the broad scope of the applicability of the present invention will become apparent to those of skill in the art from the details given hereinafter. However, it should be understood that the detailed description of the preferred embodiments of the present invention is given only by way of illustration because various changes and modifications well within the spirit and scope of the invention should become apparent to those of skill in the art in view of the following detailed description.

DETAILED DESCRIPTION OF THE INVENTION

As discussed above, the present invention provides a patterned nonwoven fabric having a cloth-like feel and an aesthetic decorative design. The fabric comprises polymeric strands which include a primary polymeric component and are bonded with a heat-activated polymeric adhesive component which adheres the respective primary components together without the use of compression. The decorative design is provided by an embossed pattern of densified areas separated by high-loft areas. The present invention also comprehends a composite material comprising a layer of the above described fabric laminated to a polymeric film and methods for making the nonwoven fabric and the composite material.

The fabric and composite material of the present invention are particularly useful for making personal care articles, garment materials, medical products, and cleaning products. Personal care articles include infant care items such as infant diapers, child care items such as training pants, and adult care items such as incontinence products, and feminine care items. Suitable garments include medical apparel, workwear, and the like.

Figure 1:
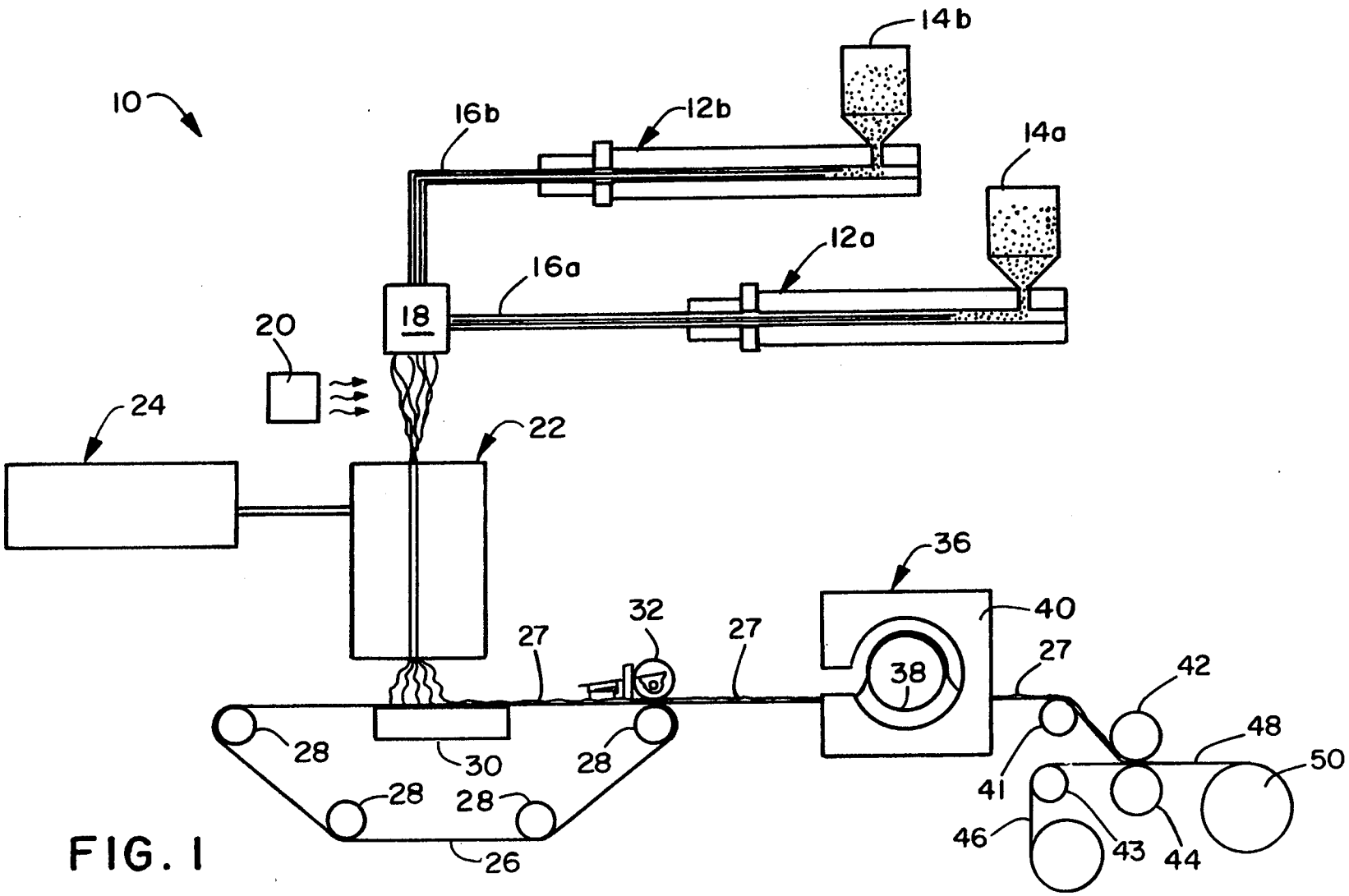
FIG. 1 is a schematic drawing of a process line for making a preferred embodiment of the present invention.

The fabric of the present invention preferably includes continuous multicomponent polymeric filaments and a process for making such an embodiment is shown in FIG. 1 and is described in detail below. Preferably, the fabric of the present invention includes bicomponent polymeric filaments wherein the two polymeric components are the primary polymeric component and the adhesive polymeric component. However, it should be understood that the fabric of the present invention can also be made with staple bicomponent fibers which are formed into a web by conventional carding, or air laying techniques, or the like. A wide variety of staple bicomponent fibers can be used to make the fabric of the present invention. Suitable commercially available staple fibers include low density polyethylene/polypropylene ES (eccentric sheath/core) bicomponent fibers available from Danaklon A/S of Varde, Denmark and high density polyethylene/polyethylene terephthalate eccentric sheath/core bicomponent fibers available from BASF Corporation, Fiber Division, of Greensboro, N.C.

The fibers or filaments used to make the fabric of the present invention are preferably crimped for higher loft. The type of crimp is preferably natural helical crimp. Bicomponent fibers and filaments with a side-by-side or eccentric sheath core configuration can be helically crimped as described below. Preferably the fibers or filaments have from about 5 to about 15 crimps per inch of extended length, counting 1 crimp per repeat cycle of the helical fibers or filaments. When the crimp is less than about 5 crimps per extended inch and the fabric has a low basis weight, the bulk of the fabric tends to be too low to form a distinct embossed pattern in the fabric, and when the crimp is greater than about 15 crimps per extended inch, the fabric tends to have a nonuniform density. Filaments and fibers having a medium crimp (5 to 15 crimps per extended inch) result in a fiber with sufficient bulk and uniformity.

After formation of the fabric web, either by continuous spunbond techniques or staple fiber techniques, the filaments of the web are bonded together with the heat-activated polymeric adhesive to integrate the web without the application of pressure. The preferred method of bonding the filaments or fibers is by through-air bonding wherein heated air is passed through the web. Through-air bonding is described in more detail below. The filaments can also be bonded by other means of applying heat such as infrared heating, oven heating, or the like. By bonding the web with heat activated adhesive instead of some type of compression bonding, the web retains its loft and has integrity through the remainder of processing and does not disintegrate during embossing or transfer or subsequent processing steps.

After the fibers or filaments are bonded together, the web is embossed with a pattern of densified areas. Preferably the embossing is carried out with embossing rolls, at least one of which is heated. When embossing rolls are used, the fabric can be embossed with very intricate patterns which are clearly visible in the fabric. The temperature of the embossing rolls can vary depending on the polymers used, the polymer components of the fibers or filaments, the basis weight of the fabric, the line speed, and other factors, but it must be sufficient to cause cold fusion bonding between the fibers or filaments. The densified area which results from the embossing is preferably from about 5 to about 30% of the fabric area. When the densified area is less than about 5%, the abrasion resistance of the fabric is too low. When the densified area of the fabric is greater than about 30%, the fabric tends to be too stiff.

The fabric web is preferably laminated to a polymeric film, such as a liquid barrier film, to make liquid impermeable outercover materials for garments, personal care absorbent articles, and the like. The fabric web can be simultaneously embossed and laminated to the polymeric film by passing the fabric web and polymeric film simultaneously through the embossing rolls. The temperature of the embossing rolls becomes particularly important when the embossing and lamination steps are bonded simultaneously. Again, the appropriate temperature of the embossing rolls depends on the particular polymers used and other factors, but if the temperature of the embossing rolls is too low, then there is insufficient lamination between the fabric web and the polymeric film, and if the temperature of the embossing rolls is too high, pinholes develop in the polymeric film which can allow leakage.

The polymeric film can also be laminated to the fabric by other means such as adhesive bonding. Suitable adhesives include hot-melt, water-based, and solvent-based adhesives. After the fiber web is embossed, the web can be adhered to the polymeric film with the adhesive by spraying the adhesive on the fabric or the film and then passing the fabric and film between the nip of two compression rolls.

Suitable polymeric films for the composite material of the present invention include XBPP-4.0 soft, blown polypropylene or polyethylene film available from Consolidated Thermoplastics Company of Schaumburg, Ill.

Although the fabric of the present invention is preferably made with continuous bicomponent filaments or staple bicomponent fibers, the fabric of the present invention can also be made with single component fibers or filaments. Instead of the primary polymeric component and the adhesive polymeric component being contained in single fiber such as with bicomponent fibers, the primary polymeric component and the adhesive polymeric component can be separate fibers or filaments integrated into a single web. According to another method, the polymeric adhesive can be added to a web of fibers or filaments in the form of a polymeric adhesive powder. In either case, the fabric web is bonded in the same manner as when the fabric web includes multicomponent fibers or filaments.

The fabric of the present invention preferably has a basis weight of at least 0.4 ounces per square yard (osy) and a thickness, in the high loft areas, of at least 20 mils. When the thickness of the high loft areas is less than about 20 mils, the embossed pattern becomes less visible. Also preferably, the polymeric components of the fibers or filaments and the degree of embossing are such that the densified areas of the embossed fabric have a luster which contrasts with the flat appearance of the high loft areas so that the embossed pattern of the fabric is clearly visible.

As discussed above, a preferred embodiment of the present invention is a polymeric fabric including continuous bicomponent filaments. The bicomponent filaments comprise a primary polymeric component A and an adhesive polymeric component B and have a cross-section, a length, and a peripheral surface. The primary and adhesive components A and B are arranged in substantially distinct zones across the cross-section of the bicomponent filaments and extend continuously along the length of the bicomponent filaments. The adhesive component B constitutes at least a portion of the peripheral surface of the bicomponent filaments continuously along the length of the bicomponent filaments.

Figure 2A:
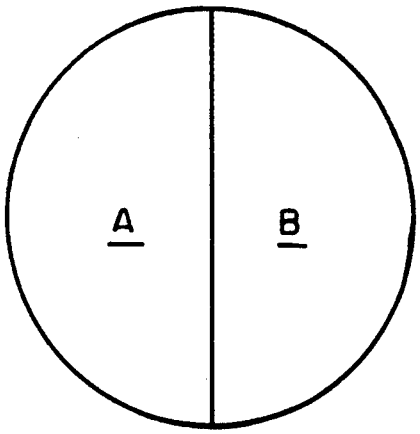
FIG. 2A is a schematic drawing illustrating the cross section of a filament made according to a preferred embodiment of the present invention with the polymer components A and B in a side-by-side arrangement.
Figure 2B:
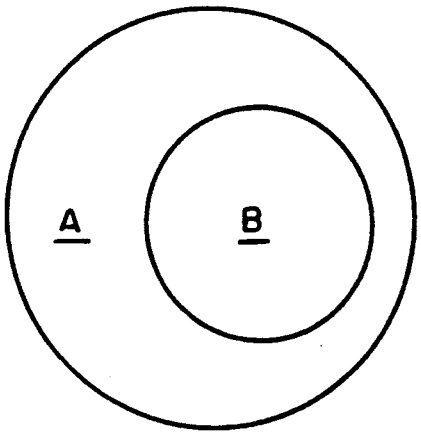
FIG. 2B is a schematic drawing illustrating the cross section of a filament made according to a preferred embodiment of the present invention with the polymer components A and B in an eccentric sheath/core arrangement.
Figure 2C:
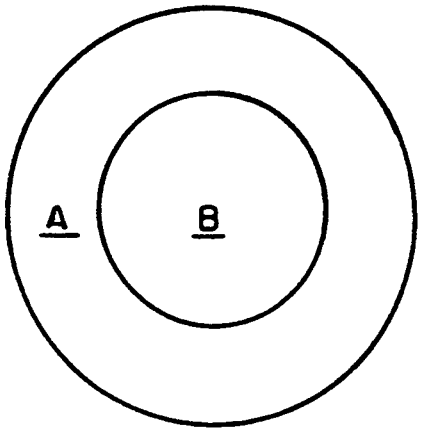
FIG. 2C is a schematic drawing illustrating the cross section of a filament made according to a preferred embodiment of the present invention with the polymer components A and B in an concentric sheath/core arrangement.

The components A and B are arranged in either a side-by-side arrangement as shown in FIG. 2A or an eccentric sheath/core arrangement as shown in FIG. 2B when filaments having a natural helical crimp are desired. When uncrimped filaments are desired the components A and B may be arranged in a concentric sheath/core pattern as shown in FIG. 2C. Primary polymer component A is the core of the filament and adhesive polymer component B is the sheath in the sheath/core arrangement. Methods for extruding multicomponent polymeric filaments into such arrangements are well-known to those of ordinary skill in the art.

A wide variety of polymers are suitable to practice the present invention including polyolefins (such as polyethylene and polypropylene), polyesters, polyamides, polyurethanes, and the like. Primary polymer component A and adhesive polymer component B must be selected so that the resulting bicomponent filament is capable of developing a natural helical crimp. Preferably, the adhesive polymer component B has a melting temperature which is less than the melting temperature of the primary polymer component A.

Preferably, primary polymer component A comprises polypropylene or random copolymer of propylene and ethylene. Adhesive polymer component B preferably comprises polyethylene or random copolymer of propylene and ethylene. Preferred polyethylenes include linear low density polyethylene and high density polyethylene. In addition, adhesive polymer component B may comprise additives for enhancing the natural helical crimp of the filaments, lowering the bonding temperature of the filaments, and enhancing the abrasion resistance, strength and softness of the resulting fabric.

When polypropylene is the primary component A and polyethylene is the adhesive component B, the bicomponent filaments may comprise from about 20 to about 80% by weight polypropylene and from about 20 to about 80% polyethylene. More preferably, the filaments comprise from about 40 to about 60% by weight polypropylene and from about 40 to about 60% by weight polyethylene.

Turning to FIG. 1, a process line 10 for preparing a preferred embodiment of the present invention is disclosed. The process line 10 is arranged to produce bicomponent continuous filaments, but it should be understood that the present invention comprehends nonwoven fabrics made with multicomponent filaments having more than two components. For example, the fabric of the present invention can be made with filaments having three or four components.

The process line 10 includes a pair of extruders 12*a* and 12*b* for separately extruding the primary polymer component A and the adhesive polymer component B. Polymer component A is fed into the respective extruder 12*a* from a first hopper 14*a* and polymer component B is fed into the respective extruder 12*b* from a second hopper 14*b*. Polymer components A and B are fed from the extruders 12*a* and 12*b* through respective polymer conduits 16*a* and 16*b* to a spinneret 18. Spinnerets for extruding bicomponent filaments are well-known to those of ordinary skill in the art and thus are not described here in detail. Generally described, the spinneret 18 includes a housing containing a spin pack which includes a plurality of plates stacked one on top of the other with a pattern of openings arranged to create flow paths for directing polymer components A and B separately through the spinneret. The spinneret 18 has openings arranged in one or more rows. The spinneret openings form a downwardly extending curtain of filaments when the polymers are extruded through the spinneret. For the purposes of the present invention, spinneret 18 may be arranged to form side-by-side, eccentric sheath/core, or concentric sheath-/core bicomponent filaments illustrated in FIGS. 2A, 2B, and 2C.

The process line 10 also includes a quench blower 20 positioned adjacent the curtain of filaments extending from the spinneret 18. Air from the quench air blower 20 quenches the filaments extending from the spinneret 18. The quench air can be directed from one side of the filament curtain as shown in FIG. 1, or both sides of the filament curtain.

A fiber draw unit or aspirator 22 is positioned below the spinneret 18 and receives the quenched filaments. Fiber draw units or aspirators for use in melt spinning polymers are well-known as discussed above. Suitable fiber draw units for use in the process of the present invention include, for example, a linear fiber aspirator of the type shown in U.S. Pat. No. 3,802,817 and eductive guns of the type shown in U.S. Pat. Nos. 3,692,618 and 3,423,266, the disclosures of which are incorporated herein by reference. It should be understood, however, that other types of fiber draw units can be used to practice the present invention, such as the fiber draw unit disclosed in U.S. Pat. No. 4,340,563, the disclosure of which is also incorporated herein by reference.

Generally described, the fiber draw unit 22 includes an elongate vertical passage through which the filaments are drawn by aspirating air entering from the sides of the passage and flowing downwardly through the passage. A heater 24 supplies hot aspirating air to the fiber draw unit 22. The hot aspirating air draws the filaments and ambient air through the fiber draw unit.

An endless foraminous forming surface 26 is positioned below the fiber draw unit 22 and receives the continuous filaments from the outlet opening of the fiber draw unit. The filaments form a nonwoven web 27 on top of the forming surface 26. The forming surface 26 travels around guide rollers 28. A vacuum 30 positioned below the forming surface 26 where the filaments are deposited draws the filaments against the forming surface.

The process line 10 further includes a compression roller 32 which, along with the forwardmost of the guide rollers 28, receive the web as the web is drawn off of the forming surface 26. In addition, the process line includes a noncompressive bonding apparatus such as a through-air bonder 36. Through-air bonders are well-known to those skilled in the art and are not disclosed here in detail. Generally described, the through-air bonder 36 includes a perforated roller 38, which receives the web, and a hood 40 surrounding the perforated roller.

A pair of embossing rolls which include a pattern roll 42 and an anvil roll 44 simultaneously emboss the nonwoven fabric web 27 and laminate the web to a polymeric film 46 to form a composite material 48. Rolls 41 and 43 guide the nonwoven fabric 27 and film 46 to the nip between the embossing rolls 42 and 44. Lastly, the process line 10 includes a winding roll 50 for taking up the finished composite material 48.

Figure 3:
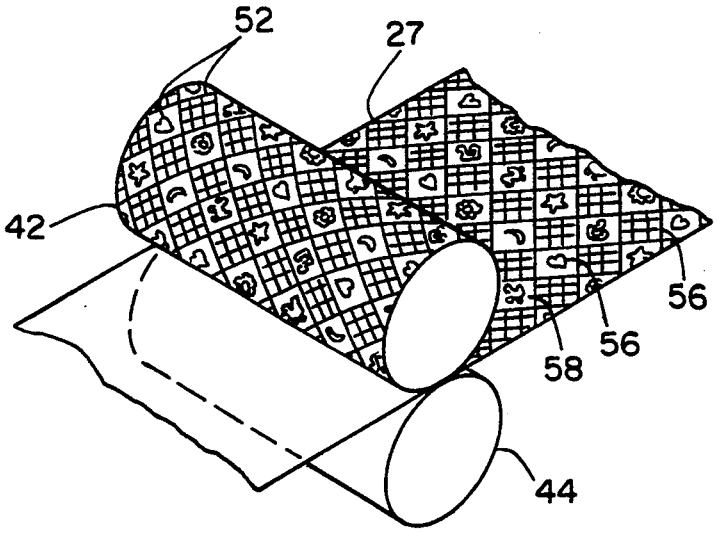
FIG. 3 is a perspective view of embossing rolls being used to make a preferred embodiment of the present invention.

The embossing rolls 42 and 44 are best shown in FIG. 3. The pattern roll 42 has a detailed raised pattern 52 which imparts corresponding densified areas 56 in the nonwoven web 27. The densified areas 56 are separated by high-loft areas 58 which are not embossed.

To operate the process line 10, the hoppers 14*a* and 14*b* are filled with the respective polymer components A and B. Polymer components A and B are melted and extruded by the respective extruders 12*a* and 12*b* through polymer conduits 16*a* and 16*b* and the spinneret 18. Although the temperatures of the molten polymers vary depending on the polymers used, when polypropylene and polyethylene are used as components A and B respectively, the preferred temperatures of the polymers range from about 370° to about 530° F. and preferably range from 400° to about 450° F.

As the extruded filaments extend below the spinneret 18, a stream of air from the quench blower 20 at least partially quenches the filaments to develop a latent helical crimp in the filaments. The quench air preferably flows in a direction substantially perpendicular to the length of the filaments at a temperature of about 45° to about 90° F. and a velocity from about 100 to about 400 feet per minute.

After quenching, the filaments are drawn into the vertical passage of the fiber draw unit 22 by a flow of hot air from the heater 24 through the fiber draw unit. The fiber draw unit is preferably positioned 30 to 60 inches below the bottom of the spinneret 18. The temperature of the air supplied from the heater 24 is sufficient that, after some cooling due to mixing with cooler ambient air aspirated with the filaments, the air heats the filaments to a temperature required to activate the latent crimp. The temperature required to activate the latent crimp of the filaments ranges from about 110° F. to a maximum temperature less than the melting point of the lower melting component which for through-air bonded materials is the second component B. The temperature of the air from the heater 24 and thus the temperature to which the filaments are heated can be varied to achieve different levels of crimp. Generally, a higher air temperature produces a higher number of crimps.

The crimped filaments are deposited through the outlet opening of the fiber draw unit 22 onto the traveling forming surface 26. The vacuum 20 draws the filaments against the forming surface 26 to form an unbonded, nonwoven web 27 of continuous filaments. The web 27 is then lightly compressed by the compression roller 32 and then through-air bonded in the through-air bonder 36. In the through-air bonder 36, air having a temperature above the melting temperature of component B and below the melting temperature of component A is directed from the hood 40, through the web 27, and into the perforated roller 38. The hot air melts the lower melting adhesive polymer component B and thereby forms bonds between the bicomponent filaments to integrate the web 27. When polypropylene and polyethylene are used as polymer components A and B respectively, the air flowing through the through-air bonder preferably has a temperature ranging from about 230° to about 280° F. and a velocity from about 100 to about 500 feet per minute. The dwell time of the web in the through-air bonder is preferably less than about 6 seconds. It should be understood, however, that the parameters of the through-air bonder depend on factors such as the type of polymers used and thickness of the web.

After being through-air bonded, the web 27 is directed by guide roll 41 to the nip between the embossing rolls 42 and 44 along with the polymeric barrier film 46 which is directed by guide roll 43. Lastly, the finished web is wound onto the winding roller 50 and is ready for further treatment or use.

Although the preferred method of carrying out the present invention includes contacting the multicomponent filaments with heated aspirating air, the present invention encompasses other methods of activating the latent helical crimp of the continuous filaments before the filaments are formed into a web. For example, the multicomponent filaments may be contacted with heated air after quenching but upstream of the aspirator. In addition, the multicomponent filaments may be contacted with heated air between the aspirator and the web forming surface. Furthermore, the filaments may be heated by methods other than heated air such as exposing the filaments to electromagnetic energy such as microwaves or infrared radiation.

The following Examples 1–3 are designed to illustrate particular embodiments of the present invention and to teach one of ordinary skill in the art the manner of carrying out the present invention.

EXAMPLE 1

A 0.7 osy basis weight bonded carded web comprising 2 denier, crimped low density polyethylene/polypropylene ES bicomponent staple fibers available from Danaklon A/S of Varde, Denmark was made using a Cardmaster 19724 carding machine, available from John Hollingsworth On Wheels, Inc. of Greenville, S.C. The fibers had an average length of 1.5 inches and a 50:50 eccentric sheath/core configuration. The fibers had a natural helical crimp ranging from about 10 to about 15 crimps per extended inch, counting 1 crimp per repeat cycle of the helical fibers in accordance with ASTM D-3937. The line speed of the carding machine was 100 feet per minute. The carded web was through-air bonded and the temperature of the air in the through-air bonder was 263° F. The through-air bonded carded web was then embossed by a pair of embossing rollers. The patterned roll had a temperature of 285° F. and the anvil roll had a temperature of 250° F. The rolls applied pressure of 35 psi to the fabric and the line speed of the embossing step was 30 feet per minute. The fabric was simultaneously embossed and thermally laminated to XBPP-4.0, soft, blown polypropylene film available from Consolidated Thermoplastics Company, of Schaumburg, Ill. The polypropylene film had a thickness of 0.6 mils. The fabric was embossed with the detailed decorative pattern shown in FIG. 3. The pattern had a bond area of 13%.

EXAMPLE 2

A 0.8 osy basis weight bonded carded web comprising 1.8 denier polyethylene/polyethylene terephthalate bicomponent staple fibers available from BASF Corporation, Fiber Division, Greensboro, N.C. was made. The fibers had a length of 1.5 inches and a 50:50 eccentric sheath/core configuration. The fibers had a natural helical crimp of about 12 crimps per extended inch, counting 1 crimp per repeat cycle of the helical fibers according to ASTM D-3937. The web was carded on a Cardmaster 19724 carding machine available from John Hollingsworth On Wheels, Inc of Greenville, S.C. The carded web was through-air bonded at 273° F. at a line speed of 120 feet per minute. The bonded carded web was then embossed with a detailed pattern similar to that shown in FIG. 3. The temperature of the pattern roll was 238° F. and the temperature of the anvil roll was 210° F. The line speed of the embossing step was 18 feet per minute and the pressure between the nip of the embossing rolls was 32 psi. After embossing, the fabric was laminated to 1.0 mil, polyethylene film available from Consolidated Thermoplastics Company, of Schaumburg, Ill. The fabric was laminated to the film with H2096 hot melt adhesive, available from Findley Company, of Wauwatosa, Wis., by spraying the hot melt adhesive on the polyethylene film at the rate of 2 grams per square meter and then passing the fabric in film between a pair of compression rolls.

EXAMPLE 3

A 0.8 osy basis weight nonwoven fabric web comprising continuous bicomponent filaments was made with the process illustrated in FIG. 1 and described above. The configuration of the filaments was side-by-side, the weight ratio of one side to the other side being 1:1. The spinhole geometry was 0.6 mm D with an L/D ratio of 4:1 and the spinneret had 525 openings arranged with 50 openings per inch in the machine direction. The composition of component A was 100% by weight PD-3445 polypropylene from Exxon of Houston, Tex., and the composition of component B was 95% by weight ASPUN 6811A polyethylene from Dow Chemical Company of Midland, Mich. The melt temperature in the spin pack was 450° F. and the spinhole throughput was 0.5 to 0.6 GHM. The quench air flow rate was 29.5 scfm and the quench air temperature was ambient, about 65° F. The aspirator feed temperature was 250° F. and the manifold pressure was 3 to 4 psi. The forming height was 10 inches. The filaments had a natural helical crimp ranging from about 3 to about 15 crimps per extended inch, counting 1 crimp per repeat cycle of the helical filaments according to ASTM D-3937. The resulting web was through-air bonded at a temperature of 257° F. and a line speed of 200 fpm. The web was embossed with a detailed pattern similar to that in FIG. 3 at pattern/anvil bond temperatures of 260°/200° F., a pressure of 20 psi, and a line speed of 25 fpm. The bond pattern had a total bond area of 13%. The embossed web was then laminated with a hot-melt adhesive to a 1.0 mil polyethylene film available from Consolidated Thermoplastics of Schaumburg, Ill. The hot-melt adhesive was the same as that used in Example 2 and was applied in the same manner.

The strength and the liquid barrier integrity of the composite materials from Examples 1–3 were measured. The strength of the lamination was measured by measuring the adhesion force between the two layers of the composite material. For each Example, the adhesion force of a 2"×4" sample was measured using a force transducer AccuForce Cadet Gage Model #544 supplied by Ametek, Inc., U.S. Gauge Division, of Sellersville, Pa. The minimum force required to separate the two plies was given in kilograms. The integrity of the liquid barrier film was measured by measuring the hydrostatic head which is a fabric's resistance to the penetration of water under static pressure. Under controlled conditions, a sample is subjected to water pressure that increases at a constant rate until leakage appears on the material's lower surface. Water pressure is measured as the hydrostatic head height reached at the first sign of leakage. Values are recorded in centimeters of water. A higher number indicates higher resistance to water penetration. The adhesion forces of the samples from Examples 1–3 were 2.4 Kg, 4.0 Kg, and 4.3 Kg respectively, and the hydrostatic head of the samples from Examples 1–3 were 110 cm, >110 cm, and >110 cm, respectively.

Figure 4:
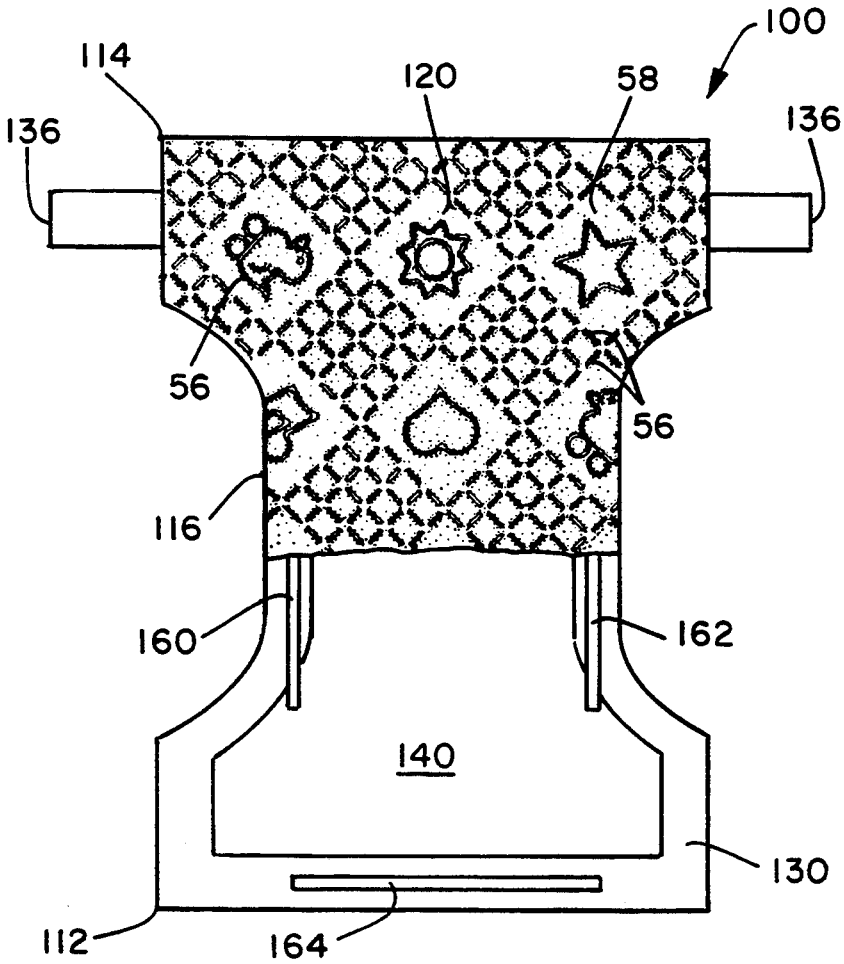
FIG. 4 is a plan view of an infant diaper made in accordance with a preferred embodiment of the present invention.

Turning to FIG. 4, a disposable diaper-type article 100 made according to a preferred embodiment of the present invention is shown. The diaper 100 includes a front waistband panel section 112, a rear waistband panel section 114, and an intermediate section 116 which interconnects the front and rear waistband sections. The diaper comprises a substantially liquid impermeable outer cover layer 120 made according to a preferred embodiment of the present invention as described above, a liquid permeable liner layer 130, and an absorbent body 140 located between the outer cover layer and the liner layer. Fastening means, such as adhesive tapes 136 are employed to secure the diaper 100 on a wearer. The liner 130 and outer cover 120 are bonded to each other and to absorbent body 140 with lines and patterns of adhesive, such as a hot-melt, pressure-sensitive adhesive. Elastic members 160, 162, and 164 can be configured about the edges of the diaper for a close fit about the wearer.

It is desirable that both the liner layer 130 and the absorbent body 140 be hydrophilic to absorb and retain aqueous liquids such as urine. Although not shown in FIG. 4, the disposable diaper 100 may include additional liquid handling layers such as a surge layer, a transfer layer or a distribution layer. These layers may be separate layers or may be integral with the liner layer 120 or the absorbent pad 140.

Although the absorbent article 100 shown in FIG. 4 is a disposable diaper, it should be understood that the nonwoven fabric and composite material of the present invention may be used to make a variety of absorbent articles, and other products such as those identified above.

While the invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and any equivalents thereto.

We claim:

1. A cloth-like liquid barrier composite material comprising:

a layer of nonwoven fabric comprising crimped polymeric strands which include a primary polymeric component, the strands being bonded together without application of pressure and with a heat-activated adhesive polymeric component which adheres the respective primary components of the strands together, the fabric having an embossed pattern of densified areas separated by high-loft areas; and a polymeric film laminated to the layer of fabric by means of said embossed pattern.

2. A composite material as in claim 1 wherein the polymeric film is a liquid barrier film.

3. A composite material as in claim 1 wherein the strands have a crimp level of about 3 to about 15 crimps per extended inch of said strand.

4. A composite material as in claim 1 wherein the strands have natural helical crimp.

5. A composite material as in claim 4 wherein the strands have at least about 3.0 natural helical crimps per extended inch.

6. A composite material as in claim 1 wherein the strands comprise multicomponent strands, the multicomponent strands comprising the primary polymeric component and the heat-activated adhesive component and having a cross-section, a length, and a peripheral surface, the primary and adhesive components being arranged in substantially distinct zones across the cross-section of the multicomponent strands and extending continuously along the length of the multicomponent strands, the adhesive component constituting at least a portion of the peripheral surface of the multicomponent strands continuously along the length of the multicomponent strands.

7. A composite material as in claim 6 wherein the multicomponent strands have natural helical crimp.

8. A composite material as in claim 7 wherein the multicomponent strands have at least about 3.0 natural helical crimps per extended inch.

9. A personal care article having an outer cover comprising the composite material of claim 1.

10. An infant diaper having an outer cover comprising the composite material of claim 1.

11. An adult incontinence product having an outer cover comprising the composite material of claim 1.

12. A feminine care absorbent product having an outer cover comprising the composite material of claim 1.

13. A training pant having an outer cover comprising the composite material of claim 1.

14. A garment having an outer cover comprising the composite material of claim 1.

* * * * *